US008448703B2

(12) United States Patent
Ross et al.

(10) Patent No.: US 8,448,703 B2
(45) Date of Patent: May 28, 2013

(54) DOWNHOLE FORMATION TESTER APPARATUS AND METHODS

(75) Inventors: Simon Ross, Tunbridge Wells (GB); Pierre Campanac, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 569 days.

(21) Appl. No.: 12/619,101

(22) Filed: Nov. 16, 2009

(65) Prior Publication Data

US 2011/0114310 A1 May 19, 2011

(51) Int. Cl.
*E21B 49/00* (2006.01)

(52) U.S. Cl.
USPC ..... 166/250.1; 166/250.17; 166/264; 175/58

(58) Field of Classification Search
USPC ..... 166/264, 250.1, 250.17, 250.07, 166/250.05, 250.01; 175/58, 40, 50, 59
See application file for complete search history.

(56) References Cited

U.S. PATENT DOCUMENTS

| | | | | |
|---|---|---|---|---|
| 3,934,468 | A | 1/1976 | Brieger | |
| 4,860,581 | A * | 8/1989 | Zimmerman et al. | 73/152.26 |
| 4,893,505 | A | 1/1990 | Marsden et al. | |
| 4,936,139 | A | 6/1990 | Zimmerman et al. | |
| 5,303,775 | A | 4/1994 | Michaels et al. | |
| 5,377,755 | A | 1/1995 | Michaels et al. | |
| 5,622,223 | A | 4/1997 | Vasquez | |
| 6,659,177 | B2 * | 12/2003 | Bolze et al. | 166/264 |
| 6,719,049 | B2 | 4/2004 | Sherwood et al. | |
| 7,302,966 | B2 | 12/2007 | Brennan, III et al. | |
| 7,380,599 | B2 | 6/2008 | Fields et al. | |
| 7,527,070 | B2 | 5/2009 | Brennan, III et al. | |
| 2003/0106313 | A1 * | 6/2003 | Huang et al. | 60/433 |
| 2006/0099093 | A1 | 5/2006 | Brennan, III et al. | |
| 2008/0156486 | A1 * | 7/2008 | Ciglenec et al. | 166/264 |
| 2009/0044951 | A1 | 2/2009 | Milkovisch et al. | |
| 2009/0165548 | A1 * | 7/2009 | Pop et al. | 73/152.51 |
| 2009/0195250 | A1 | 8/2009 | Welshans et al. | |

* cited by examiner

*Primary Examiner* — William P Neuder
*Assistant Examiner* — Ronald Runyan
(74) *Attorney, Agent, or Firm* — Cathy Hewitt; John Vereb

(57) ABSTRACT

A method according to one or more aspects of the present disclosure comprises disposing a tool in a wellbore, the tool comprising a displacement unit for pumping a fluid at least partially through the tool, a first flowline hydraulically connected to the displacement unit through a valve network, and a second flowline hydraulically connected to the displacement unit; pumping a fluid from the first flowline to the second flowline; monitoring a pressure at a chamber of the displacement unit; and monitoring flowing pressure in the first flowline across the valve network from the displacement unit.

15 Claims, 7 Drawing Sheets

F

DOWNHOLE FORMATION TESTER APPARATUS AND METHODS

BACKGROUND

This section of this document is intended to introduce various aspects of the art that may be related to various aspects of the present disclosure described and/or claimed below. This section provides background information to facilitate a better understanding of the various aspects of the present invention. That such art is related in no way implies that it is prior art. The related art may or may not be prior art. It should therefore be understood that the statements in this section of this document are to be read in this light, and not as admissions of prior art.

Wells are generally drilled into the ground or ocean bed to recover natural deposits of oil and gas, as well as other desirable materials that are trapped in geological formations in the Earth's crust. A well is typically drilled using a drill bit attached to the lower end of a "drill string." Drilling fluid, or "mud," is typically pumped down through the drill string to the drill bit. The drilling fluid lubricates and cools the drill bit, and it carries drill cuttings back to the surface in the annulus between the drill string and the wellbore wall.

For successful oil and gas exploration, it may be useful to have information about the subsurface formations that are penetrated by a wellbore. For example, one aspect of standard formation evaluation relates to the measurements of the reservoir fluid pressure and/or formation permeability, among other reservoir properties. These measurements may be used to predicting the production capacity and production lifetime of a subsurface formation.

One technique for measuring reservoir properties includes lowering a "wireline" tool into the well to measure formation properties. A wireline tool is a measurement tool that is suspended from a wireline in electrical communication with a control system disposed on the surface. The tool is lowered into a well so that it can measure formation properties at desired depths. A typical wireline tool may include a probe or other sealing device, such as a pair of packers, that may be pressed against the wellbore wall to establish fluid communication with the formation. This type of wireline tool is often called a "formation tester." Using the probe, a formation tester measures the pressure of the formation fluids, generates a pressure pulse, which is used to determine the formation permeability. The formation tester tool also typically withdraws a sample of the formation fluid that is either subsequently transported to the surface for analysis or analyzed downhole.

In order to use any wireline tool, whether the tool be a resistivity, porosity or formation testing tool, the drill string is usually removed from the well so that the tool can be lowered into the well. This is called a "trip" uphole. Then, the wireline tools may be lowered to the zone of interest. A combination of removing the drill string and lowering the wireline tools downhole are time-consuming measures and can take up to several hours, depending upon the depth of the wellbore. Because of the great expense and rig time required to "trip" the drill pipe and lower the wireline tools down the wellbore, wireline tools are generally used only when additional information about the reservoir is beneficial and/or when the drill string is tripped for another reason, such as changing the drill bit size. Examples of wireline formation testers are described, for example, in U.S. Pat. Nos. 3,934,468; 4,860,581; 4,893,505; 4,936,139; 5,622,223; 6,719,049 and 7,380,599 all herein incorporated by reference in their entirety.

To avoid or minimize the downtime associated with tripping the drill string, another technique for measuring formation properties has been developed in which tools and devices are positioned near the drill bit in a drilling system. Thus, formation measurements are made during the drilling process and the terminology generally used in the art is "MWD" (measurement-while-drilling) and/or "LWD" (logging-while-drilling). A variety of downhole MWD and LWD drilling tools are commercially available. Further, formation measurements can be made in tool strings which do not have a drill bit but which may circulate mud in the borehole.

MWD typically refers to measuring the drill bit trajectory as well as wellbore temperature and pressure, while LWD typically refers to measuring formation parameters or properties, such as resistivity, porosity, permeability, and sonic velocity, among others. Real-time data, such as the formation pressure, facilitates making decisions about drilling mud weight and composition, as well as decisions about drilling rate and weight-on-bit, during the drilling process. While LWD and MWD have different meanings to those of ordinary skill in the art, that distinction is not germane to this disclosure, and therefore this disclosure does not distinguish between the two terms.

Formation evaluation tools capable of performing various downhole formation tests typically include a small probe and/or pair of packers that can be extended from a drill collar to establish hydraulic coupling between the formation and sensors and/or sample chambers in the tool. Some tools may use a pump to actively draw a fluid sample out of the formation so that it may be stored in a sample chamber in the tool for later analysis. Such a pump may be powered by a generator in the drill string that is driven by the mud flow down the drill string. Examples of LWD formation testers are described, for example, in U.S. Pat. App. Pub. Nos. 2008/0156486 and 2009/0195250 all herein incorporated by reference in their entirety.

BRIEF DESCRIPTION OF THE DRAWINGS

The present disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1:
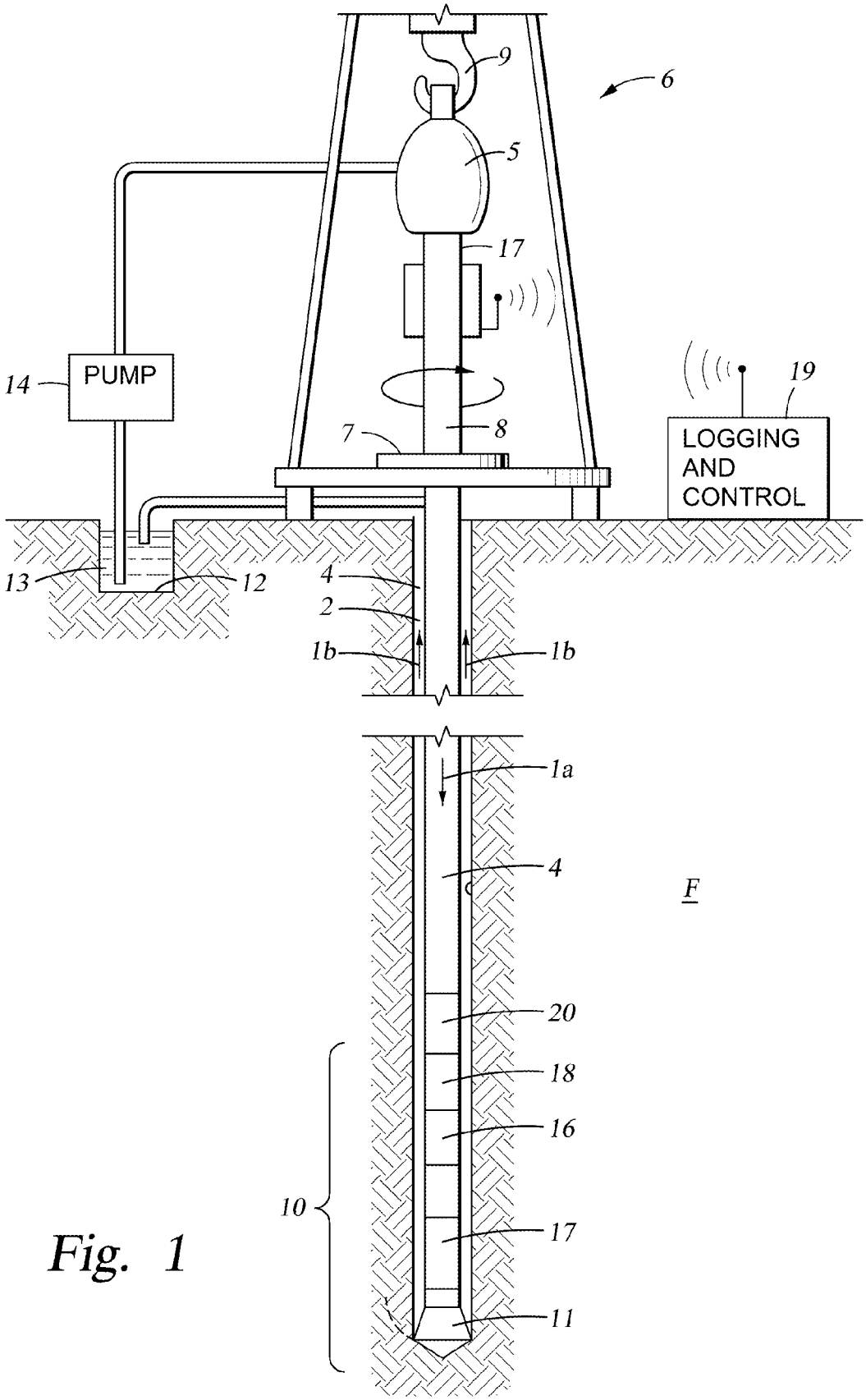
FIG. 1 is a schematic view of an apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Those skilled in the art, given the benefit of this disclosure, will appreciate that the disclosed apparatuses and methods have applications in operations other than drilling and that drilling is not necessary to practice this invention. While this disclosure is described in relation to sampling, the disclosed apparatus and method may be applied to other operations including injection techniques.

The phrase "formation evaluation while drilling" refers to various sampling and testing operations that may be performed during the drilling process, such as sample collection, fluid pump out, pretests, pressure tests, fluid analysis, and resistivity tests, among others. It is noted that "formation evaluation while drilling" does not necessarily mean that the measurements are made while the drill bit is actually cutting through the formation. For example, sample collection and pump out are usually performed during brief stops in the drilling process. That is, the rotation of the drill bit is briefly stopped so that the measurements may be made. Drilling may continue once the measurements are made. Even in embodiments where measurements are only made after drilling is stopped, the measurements may still be made without having to trip the drill string.

In this disclosure, "hydraulically coupled" or "hydraulically connected" and similar terms, may be used to describe bodies that are connected in such a way that fluid pressure may be transmitted between and among the connected items. The term "in fluid communication" is used to describe bodies that are connected in such a way that fluid can flow between and among the connected items. It is noted that hydraulically coupled or connected may include certain arrangements where fluid may not flow between the items, but the fluid pressure may nonetheless be transmitted. Thus, fluid communication is a subset of hydraulically coupled.

FIG. 1 is a schematic of a well system according to one or more aspects of the present disclosure. The well can be onshore or offshore. In the depicted system, a borehole or wellbore 2 is drilled in a subsurface formation(s), generally denoted as "F". The depicted drill string 4 is suspended within wellbore 2 and includes a bottomhole assembly 10 with a drill bit 11 at its lower end. The surface system includes a deployment assembly 6, such as a platform, derrick, rig, and the like, positioned over wellbore 2. Depicted assembly 6 includes a rotary table 7, kelly 8, hook 9 and rotary swivel 5. Drill string 4 is rotated by the rotary table 7 which engages the kelly 8 at the upper end of the drill string. Drill string 4 is suspended from hook 9, attached to a traveling block (not shown), through kelly 8 and rotary swivel 5 which permits rotation of the drill string relative to the hook. As is well known, a top drive system may alternatively be used.

The surface system may further include drilling fluid or mud 12 stored in a pit 13 or tank at the wellsite. A mud pump 14 delivers drilling fluid 12 to the interior of drill string 4 via a port in swivel 5, causing the drilling fluid to flow downwardly through drill string 4 as indicated by the directional arrow 1*a*. The drilling fluid exits drill string 4 via ports in the drill bit 11, and then circulates upward through the annulus region between the outside of the drill string and the wall of the wellbore, as indicated by the directional arrows lb. In this well known manner, the drilling fluid lubricates drill bit 11 and carries formation cuttings up to the surface as it is returned to pit 13 for recirculation.

The depicted bottomhole assembly ("BHA") 10 includes a logging-while-drilling ("LWD") module 20, a measuring-while-drilling ("MWD") module 16, a roto-steerable system and motor 17, and drill bit 11. According ton one or more aspects of the present disclosure, LWD module 20 may be a downhole formation tester (e.g., sampling tool).

LWD module 20 is housed in a special type of drill collar, as is known in the art, and can contain one or a plurality of known types of logging tools. It will also be understood that more than one LWD and/or MWD module can be employed. LWD module includes capabilities for measuring, processing, and storing information, as well as for communicating with the surface equipment.

MWD module 16 is also housed in a special type of drill collar, as is known in the art, and can contain one or more devices for measuring characteristics of the drill string and drill bit. BHA 10 may include an apparatus for generating electrical power to the downhole system. This may typically include a mud turbine generator powered by the flow of the drilling fluid, it being understood that other power and/or battery systems may be employed. The MWD module may include, for example, one or more of the following types of measuring devices: a weight-on-bit measuring device, a torque measuring device, a vibration measuring device, a shock measuring device, a stick slip measuring device, a direction measuring device, and an inclination measuring device.

BHA 10 may include an electronics module or subsurface controller (e.g., electronics, telemetry), generally denoted as 18. Subsurface controller 18 (e.g., controller) may provide a communications link for example between a controller 19 and the downhole equipment (e.g., the downhole tools, sensors, pumps, gauges, etc.). Controller 19 is an electronics and processing package that can be disposed at the surface. Electronic packages and processors for storing, receiving, sending, and/or analyzing data and signals may be provided at one or more of the modules as well.

Controller 19 may be a computer-based system having a central processing unit ("CPU"). The CPU is a microprocessor based CPU operatively coupled to a memory, as well as an input device and an output device. The input device may comprise a variety of devices, such as a keyboard, mouse, voice-recognition unit, touch screen, other input devices, or combinations of such devices. The output device may comprise a visual and/or audio output device, such as a monitor having a graphical user interface. Additionally, the processing may be done on a single device or multiple devices. Controller 19 may further include transmitting and receiving capabilities for inputting or outputting signals.

Figure 2:
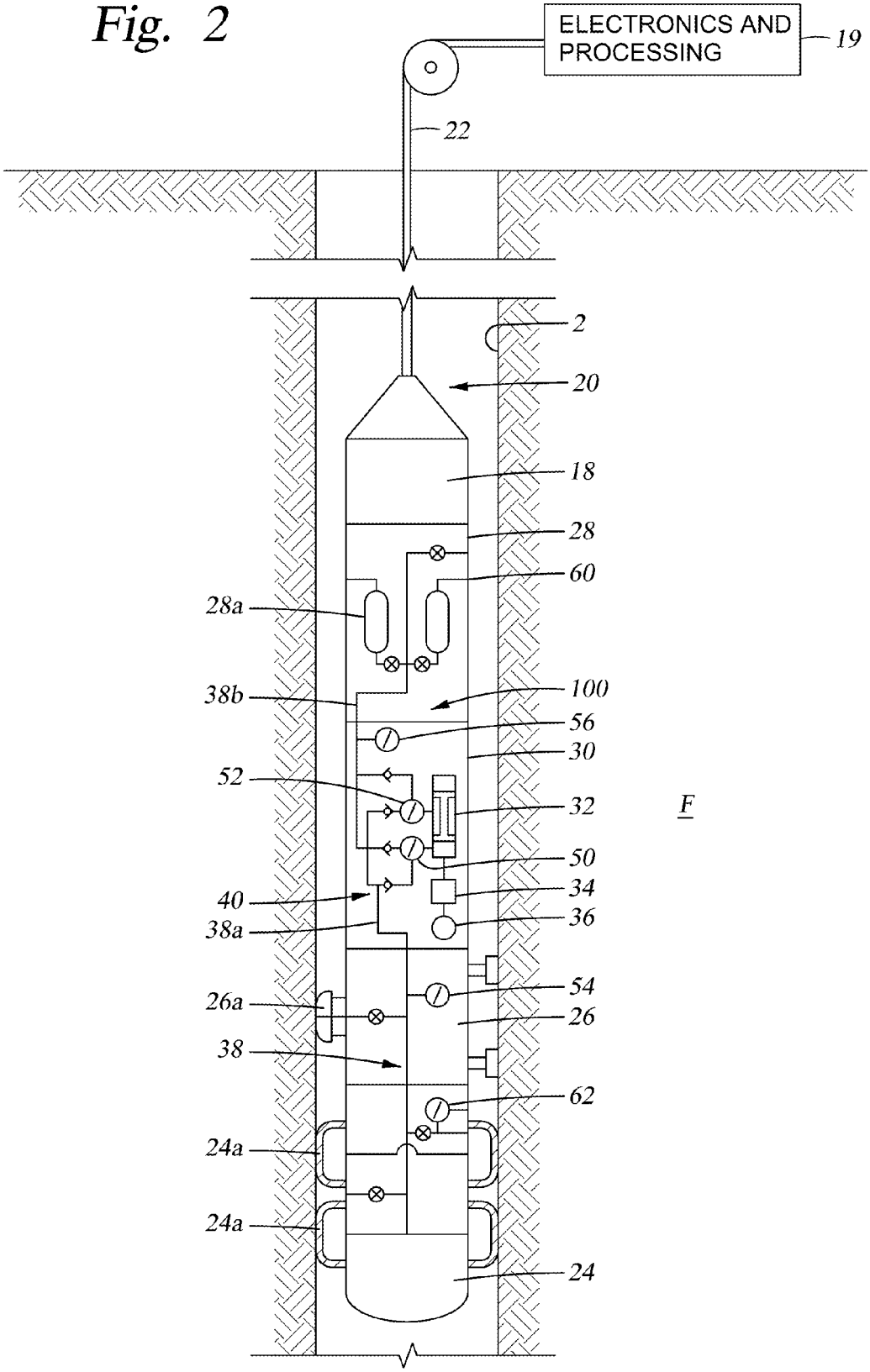
FIG. 2 is a schematic view of an apparatus according to one or more aspects of the present disclosure.

FIG. 2 is a schematic of an apparatus according to one or more aspects of the present disclosure. Formation tester 20 is depicted lowered by a wireline 22 conveyance into wellbore 2 for the purpose of evaluating formation "F". At the surface, wireline 22 may be communicatively coupled to surface controller 19. Depicted tool 20 comprises a packer tool (e.g., module) 24, probe tool or module 26, a sample module 28, pumpout system 30 (e.g., pumpout or pump module) and subsurface electronics package 18 (e.g., controller). Tool 20 includes a flowline 38 (e.g., hydraulic circuit) hydraulically coupling one or more of the devices of tool 20 and formation "F" and/or wellbore 2. Examples of hydraulic circuits having one or more features applicable to the present disclosure are disclosed in U.S. Pat. Nos. 7,302,966 and 7,527,070 and U.S. Pat. Appl. Publ. No. 2006/0099093, which are incorporated herein by reference.

Pumpout module 30 (e.g., pump module) includes a displacement unit ("DU") 32 (e.g., reciprocating piston, pump) actuated by a power source 34 to pump fluid (e.g., wellbore fluid, formation fluid, sample fluid) at least partially through tool 20. Such pumping may include, for example, drawing fluid into the tool, discharging fluid from the tool, and/or moving fluid from one location to another location with the tool, as are well known in the art. Examples of bi-directional displacement units (e.g., pumps) are disclosed for example in U.S. Pat. Nos. 5,303,775 and 5,337,755, which are incorporated herein by reference. Power source 34 may be, for example, a hydraulic pump or motor driving a mechanical shaft. An example of a power source including one or more hydraulic pumps is disclosed in U.S. Pat. Appl. Publ. No. 2009/0044951 which is incorporated herein by reference. An example of a power source including a motor driving a mechanical shaft is disclosed in U.S. Pat. Appl. Publ. No. 2008/0156486 which is incorporated herein by reference. A power source gauge 36 (e.g., sensor) is depicted connected with power source 34 that may measure, for example, the force, hydraulic pressure (e.g., Bourne gauge, etc.), electric current or motor torque. In FIG. 2, power source gauge 36 is depicted a differential pressure gauge to indicate the force applied to displacement unit 32 to drive pitons 32*p*. Fluid may be routed to and from various devices, for example, from formation "F" and/or wellbore 2 via probe module 26 to sample module 28 and sample containers 28*a*, through downhole fluid analyzers, to and from packer module 24, and discharged to wellbore 2. In some embodiments, displacement unit 32 may be utilized to pump fluid into packers 24*a* to inflate them.

Figure 3:
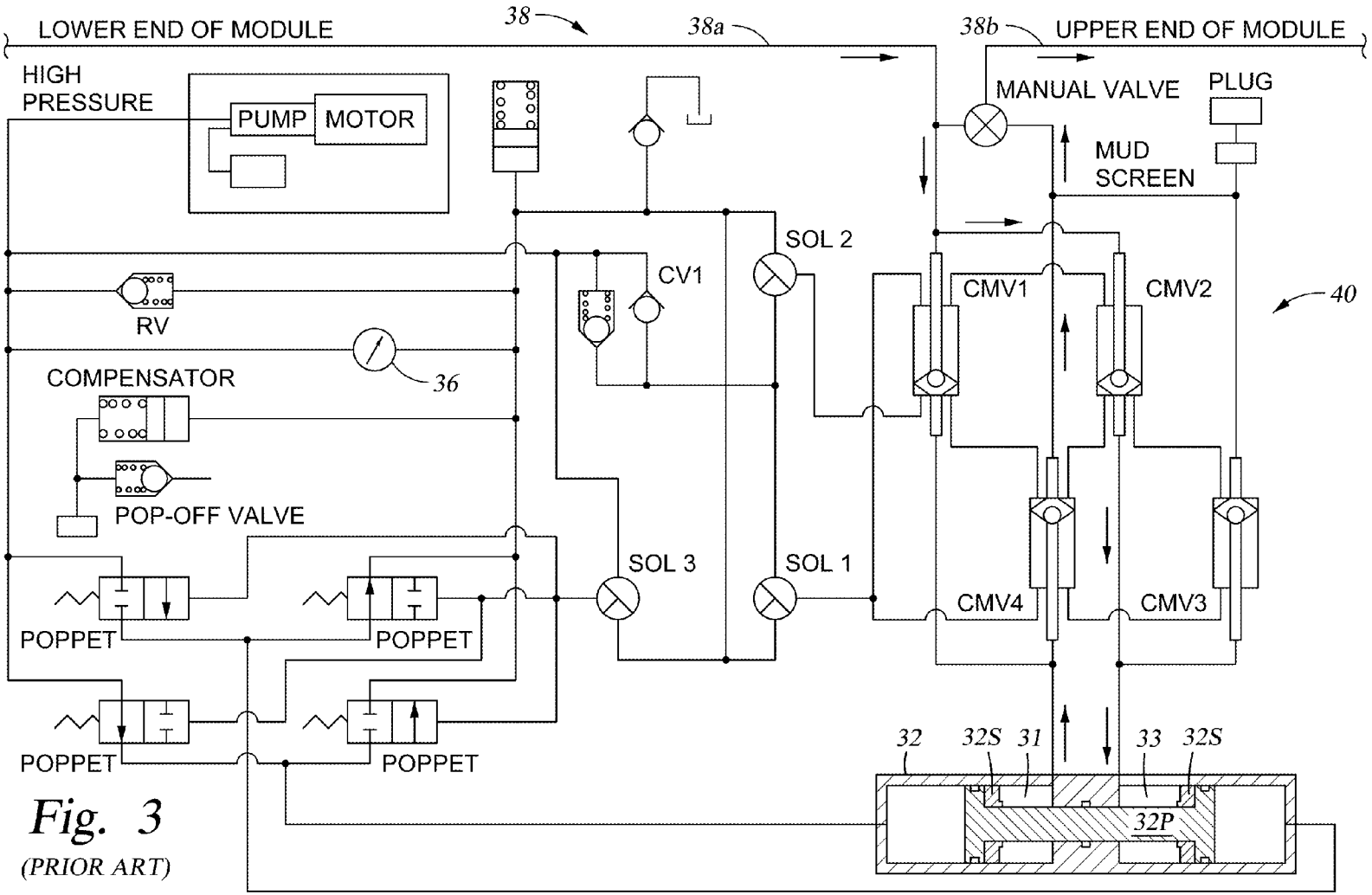
Fig. 3 (PRIOR ART)
FIG. 3 is a schematic diagram of a prior art pump system of a wellbore tool.

FIG. 3 is a schematic diagram of a prior art pumping assembly or system of a formation evaluation tool. FIG. 3 depicts pumping fluid from one side of a pumpout module to the other side of the pumpout module (e.g., pumpout system). The system depicted in FIG. 3 is described herein as a "pumping up" cycle for pumping fluid at least partially through a formation tester from below a pump module to above a pumpout module (wherein below and above refer to the example depicted in FIG. 2). The depicted system comprises displacement unit 32 (e.g., pump) hydraulically connected within a flowline, identified generally by the numeral 38, for displacing fluid at least partially through tool 20. Displacement unit 32 is connected to flowline 38 by a valve network 40 which may include one or more mud valves CMV1-CMV4 for selectively communicating fluid to and from displacement unit 32 through flowline 38. For purposes of clarity and description, flowline 38 is described herein as having a first flowline 38*a* (e.g., flow line portion) and a second flowline 38*b* (e.g., flowline portion). First and second flowlines 38*a*, 38*b* may be referred to alternatively as inflow lines and outflow lines relative to the operation (e.g., pump-up or pump-down). Mud valves CMV1-CMV4 are depicted as passive valves (e.g., check valves) in FIG. 3. Passive valves CMV1-CMV4 "passively" ensure that whatever direction that piston 32*p* is traveling that the fluid will flow through valve network (e.g., flow-up in FIG. 3, or down). For example hydraulic pressure is directed from power source 34, depicted as a hydraulic pump, through solenoids SOL1 and SOL2 at the beginning of the pumping operation to establish the pumping direction (e.g., pump-up from flowline 38*a* to 38*b* or pump-down from flowline 38*b* to 38*a*) of valve network 40. Solenoids SOL1 and SOL2 may shift a sliding sleeve for example to set the bias of check valves CMV1-CMV4.

The solenoid SOL3 and the associated poppet valve network is provided to reciprocate the central piston 32*p* of displacement unit 32 by directing the force (e.g., hydraulic pressure) from power source 34 to act on opposing chambers 31 and 33 of displacement unit 32. The system may include sensors 32*s* to detect, for example, the position (e.g., displacement) of piston 32*p*. Sensors 32*s* may comprise various types of sensors, gauges and devices and associated electronic systems.

Operation of the pumping system is described with reference to a "pump-up" operation depicted in FIG. 3, fluid is drawn from the right in first flowline 38*a* (e.g., from lower end of the pumpout module) by displacement unit 32 and pumped through second flowline 38*b*. Mud valves CMV1-CMV4 are utilized to route the fluid to and from displacement unit 32. In the depicted operation, fluid flow is reversed as desired for the particular operation, for example, to pump fluid to sample chambers 26*a* or to packers 24*a* for inflation.

Log quality control ("LQC") in prior art systems, such as depicted in FIG. 3, utilizes a hydraulic pressure gauge 36, sometimes referred to as the Bourne Gauge. The Bourne Gauge reads pump out hydraulic pressure ("POHP") and may be an essential part of a log quality control in particular to indicate that fluid is flowing. This type of log quality control indicates the quantitative output. For example, the pressure differential generated by pump 32 (e.g., inferred pump output) is computed as POHP (e.g., hydraulic pressure of power supply 34) multiplied by the displacement unit 32 ratio. The hydrostatic pressure is known from pressure data measured prior to setting the probe 26*a* (FIG. 2). The log quality control may consist of verifying the equation: hydrostatic pressure= (flowline pressure)+(POHP*Displacement Unit Ratio).

According to one or more aspects of the present disclosure, a pumpout system and method for improving the estimation of pumping flow rates (e.g., pumping times) particularly in gas environments, is addressed. Referring again to FIG. 2, a chamber pressure gauge 50 (e.g., sensor) is shown hydraulically coupled to chamber 31 of displacement unit 32 and a chamber pressure gauge 52 (e.g., sensor) is shown hydraulically coupled to chamber 33 of displacement unit 32. Chamber pressure gauges 50, 52 are depicted connected with the flowline between displacement unit 32 and valve network 40 (e.g., mud valves). Depending on the position of piston 32*p*, fluid (e.g., liquid, gas, mixture) is either pulled into a chamber 31, 33 from a flowline or expelled from a chamber 31, 33 into a flowline. Further, chambers 31, 33 alternate between high pressure and low pressure depending on the direction of travel of piston 32*p*. According to one or more aspects of the present disclosure, pressure gauges 50, 52 may be in communication with a controller (e.g., subsurface controller 18 and/or surface controller 19) to provide measurements for computing flow rates and/or to control the operation of displacement unit 32 and the formation testing tool.

Figure 4:
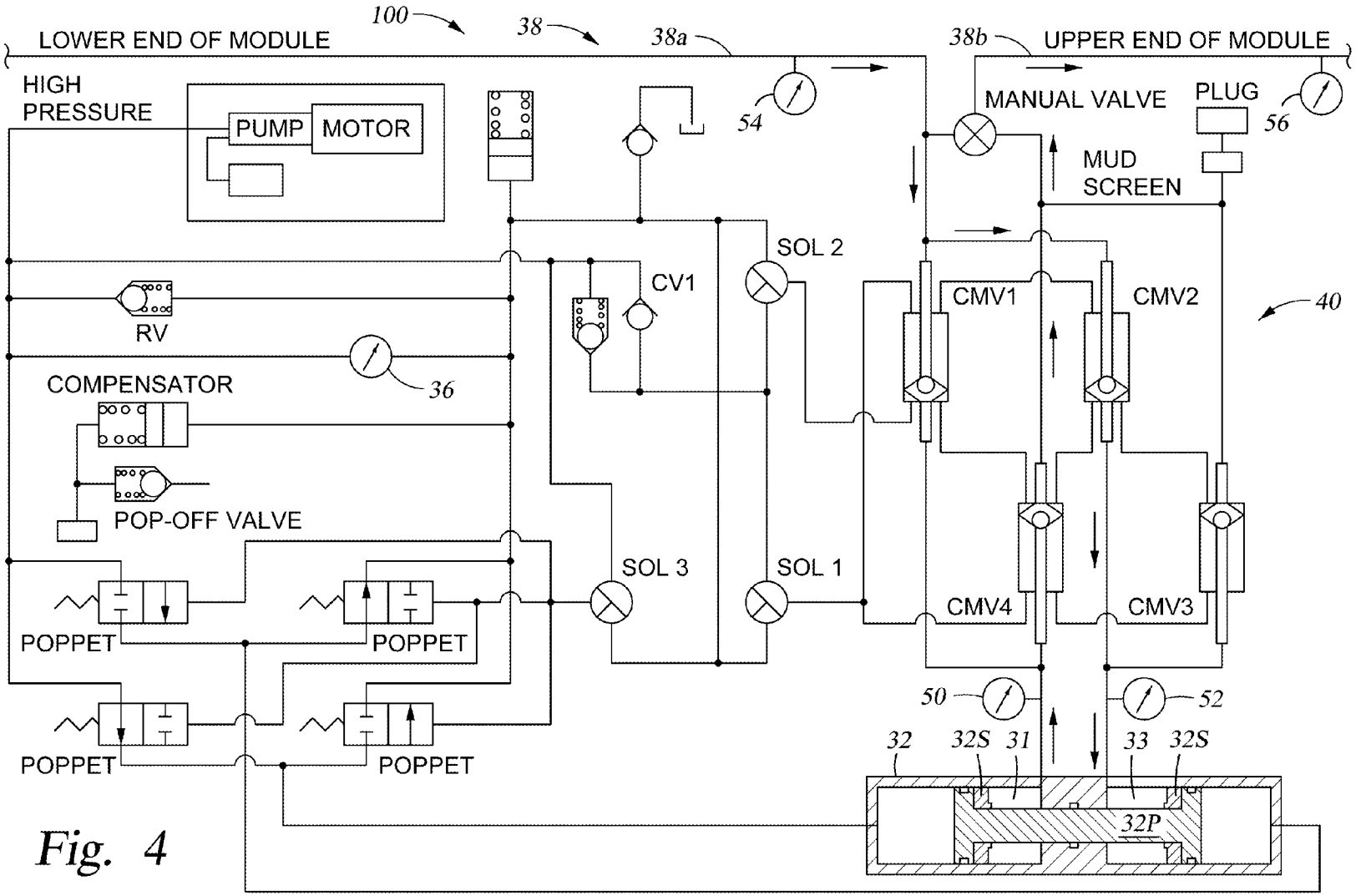
FIG. 4 is a schematic diagram of a system according to one or more aspects of the present disclosure.
Figure 5:
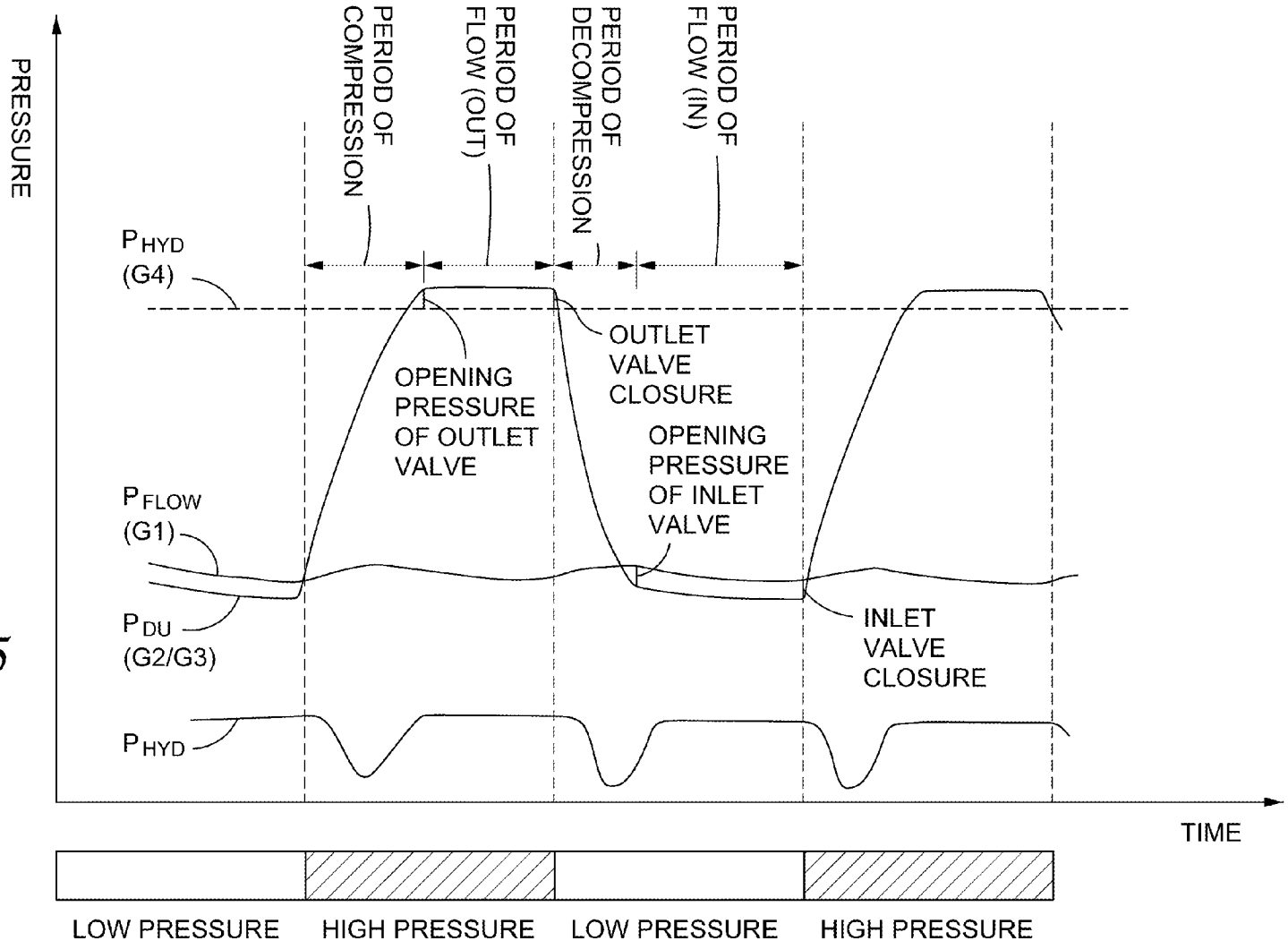
FIG. 5 is a graphical depiction of operation of an apparatus according to one or more aspects of the present disclosure.

FIG. 4 is a schematic diagram of a pump system, generally denoted by the numeral 100, of tool 20 according to one or more aspects of the present disclosure. FIG. 5 is a graphical demonstration of operation of tool 20 and pump system 100 of FIG. 4 according to one or more aspects of the present disclosure. Displacement unit 32 is depicted as a two-stroke piston pump. Chamber pressure gauge 50 is hydraulically coupled to chamber 31 of displacement unit 32. Depicted chamber pressure gauge 52 is hydraulically coupled to chamber 33 of displacement unit 32. Power source gauge 36, depicted as a differential pressure gauge, may measure the resultant pressure ($P_R$) in displacement unit 32 as piston 32*p* reciprocates in response to high and low pressures. Surface controller 19 (FIG. 2) and/or subsurface controller 18 may be in electronic communication (wired and/or wireless) with one or more of chamber pressure gauges 50 and 52, flowline pressure gauges 54 and 56, power source force 36 (e.g., resultant pressure) and displacement unit 32 for example via solenoid SOL3. Communication with the pressure gauges may be utilized for example to monitored measured (e.g., sensed) pressures etc.

Depicted tool 20 (FIG. 2) and system 100 of FIG. 4 includes a pressure gauge 54 hydraulically coupled to first flowline 38*a* and/or a pressure gauge 56 hydraulically coupled to second flowline 38*b*. Flowlines 38*a*, 38*b* are portions of the flowline of pump system 100 located on opposing sides of displacement unit 32 and valve network 40. With reference to tool 20, depicted in FIGS. 2 and 4, flowline 38*a* is referred to relative to the lower end of pumpout module 30 or below valve network 40 relative to displacement unit 32. Flowline pressure gauge 54 is located in probe module 26 in the example depicted in FIG. 2. Similarly, pressure gauge 56 is depicted and described at the opposite side of valve network 25 relative to displacement unit 32 and gauge 54. However, it is known that the positioning of tool components and the direction of flow can vary. Therefore, for the purpose of description, pressure gauge 54 and 56 are referred to generally as flowline pressure gauges and recognized as being hydraulically coupled for purposes of measuring (e.g., sensing) pressure in respective portions of the tool's flowline on opposing sides of valve network 40 and displacement unit 32. In the operation depicted in FIG. 4, pressure gauge 54 senses the inflow (e.g., flowing) pressure at flowline 38*a*.

Referring to the graph of FIG. 5, high pressure is seen on one side of displacement unit 32 and low pressure on the opposite side. In FIG. 4, chamber 31 is depicted as the high pressure chamber and chamber 33 is depicted as the low pressure chamber as piston 32*s* travels from left to right. Chambers 31 and 33 alternate between high and low pressure chambers depending on the configuration of SOL3 and the poppet valves. Passive check valves CMV1-CMV4 have opening pressures of about 50 psi in this example.

The pressure effects across displacement unit 32 (e.g., chambers 31, 33) during a passive pumping system 100 operation are now described with reference in particular to FIGS. 2, 4 and 5. The pumping operation is described and depicted as a "pump-up" operation (e.g., fluid flow from flowline 38*a* to 38*b* in FIG. 4) wherein fluid is being expelled from tool 20 into the hydrostatic column for example. Referring to FIG. 2, fluid is being expelled through port 60 into wellbore 2 (e.g., hydrostatic column). Hydrostatic pressure ($P_{HYD}$) is measured at flowline pressure gauge 56. The flowing pressure ($P_{FLOW}$) is measured at flowline pressure gauge 54 (e.g., inflow), depicted in probe module 26 (FIG. 2) (e.g., drawing fluid in). The resultant pressure ($P_R$) in displacement unit 32 as piston 32*p* reciprocates may be measured via gauge 36.

Flowing pressure ($P_{FLOW}$) is depicted in FIG. 5 with small drawdowns and buildups. In this instance one displacement unit (e.g., chamber) pressure gauge ($P_{DU}$) is being monitored. The operation is described with reference to $P_{DU}$ at chamber 33 of displacement unit 32 (e.g., pressure gauge 52), although the $P_{DU}$ trace depicted in FIG. 5 would be similar in terms of pressure gauge 50, but shifted in time by the stroke of piston 32*p*.

According to one or more aspects of the present disclosure, utilization of pump system 100 facilitates detecting or monitoring the closing, and opening, of mud valves CMV1-CMV4 via measurements of one or more of pressure gauges 50, 52, 54, 56, for example by comparing flowing pressures measured in the first and/or second flowlines 38*a* and/or 38*b* across the valve network 40 with pressure gauges 54 and/or 56 and pump chamber pressures measured in the pump chambers 31 and/or 33 with the pressure gauges 50 and or 52. The comparison may additionally involve the cracking pressure of mud valves CMV1-CMV4. Utilization of pump system 100 facilitate may also provide improved control and operation of tool 20. Although described in terms of discharging sample fluid to the wellbore, one skilled in the art will recognize use of the tool and system for pumping (e.g., drawing) fluid between different locations relative to displacement unit 32.

Proceeding along the operational path of displacement unit 32 the opening and closing of valves CMV1-CMV4 are depicted as the sampled fluid is drawn into displacement unit 32 by reciprocating the piston 32*p* and discharged from displacement unit 32. For example, displacement unit 32 has to overcome the hydrostatic pressure in the wellbore as well as the cracking pressure of valve(s) (e.g. CMV3) on the high pressure side (e.g., chamber 33 as piston 32*p* moves in displacement unit 32 to the left in FIG. 4) when fluid is being expelled in to the hydrostatic column (e.g., wellbore 2). If the formation fluid being sampled is compressible (e.g., gas, gas-liquid mixture), there will be a period of time where fluid is not technically flowing (e.g., no-flow), instead it is being compressed against the hydrostatic column. Compression of the fluid, and thus no-flow, is depicted by the curve $P_{DU}$ and the delay in the chamber pressure overcoming the hydrostatic pressure. The actual or true flowing time of the sampled fluid being discharged is illustrated as the period between the opening of the outlet mud valve (e.g., CMV3) and the closing of the outlet closure valve. Then, as piston 32*p* moves in displacement unit 32 (e.g., to the right in FIG. 4), the pressure in chamber 33 in this depiction decreases to a level below the pressure ($P_{FLOW}$) in flowline 38*a* (e.g., gauge 54), the difference may be the cracking pressure of valve(s) CMV1-CMV4. At this point the inlet mud valve (e.g., CMV2) to chamber 33 opens and the pressure traces of the flowline pressure and the pressure of chamber 33 remain substantially parallel.

The detection of mud valve opening and/or closing by monitoring measurements of one or more of pressure gauges 50, 52, 54, 56 described herein may be more robust than monitoring the magnitude of the variation of a pump chamber pressure variations. For example, the variation of a pump chamber pressure may be large and the mud valves may be open to allow formation to flow in one pump chamber (for example when sampling formation fluid using the packer module 24). The large variation of a pump chamber pressure may alternatively indicate that the mud valves may be closed and that formation fluid is being compressed and/or decompressed in one pump chamber.

When one of the mud valve CMV1 or CMV2 partially fails (e.g., leaks), which is not an uncommon event, the pump system 100 may run in half stroking mode (i.e., only one of the chamber 31 or 33 may be pumping fluid in flowline 38). Thus, it may be useful to have two pump chamber pressure gauges 50 and 52 so that pumping monitoring may continue using the gauge monitoring the chamber that is still pumping fluid.

Monitoring of various pressures, as illustrated for example with reference to FIGS. 4 and 5, may facilitate identifying the open and closed states of passive valves (CMV1-CMV4) relative to the stroke position of piston 32*p*. According to one or more aspects of the present disclosure, the portion of the displacement of piston 32*p* that corresponds to the compression/decompression phase (e.g., no-flow phase) of the pumped fluid may be identified for example to correspond with a closed valve (e.g., CMV1-CMV4). Identifying the no-flow associated with displacement of piston 32*p* may facilitate correcting flow rate estimates to account for no-flow. Flow rate (e.g., pumping rate) estimates may be more accurately made by utilizing the time and/or length of displacement of piston 32*p* that is associated with pumping of fluid (e.g., effective stroke) relative to the time and/or displacement of piston 32*p* that may be associated with compressing the fluid (e.g., no-flow).

The position of piston 32*p* may be identified as a function of time, for example, utilizing Hall Effect sensor data (e.g., sensors 32*s*), pump speed (e.g., rpm) data, etc. and/or as a function of displacement. Identifying no-flow phase data in combination with piston 32*p* position may facilitate determining the effective stroke of the piston. Knowledge of the effective stroke of piston 32*p* permits for more accurate determination of the fluid flow rate provided by displacement unit 32.

According to one or more aspects of the present disclosure, system 100 may be utilized to identify pressure losses due to friction and to locate a failure or problem in a particular mud valve (e.g., CMV1-CMV4) by monitoring pressures in chamber 31 and/or chamber 33 via gauges 50, 52, as well as other pressures via gauges 54, 56, and/or 36. Identifying the actual friction losses in the system may provide improved control and operation of tool 20. In some tools, identification of problems such as plugs and leaks in a particular mud valve may facilitate operating the tool 20 to direct fluid flow around identified problems and/or to correct a problem (e.g., back flowing to release a plug).

For example, a failure of a mud valve to close (e.g., leaking) may be resolved by inducting a high flow rate transient to dislodge the debris that may be preventing the complete closure of the leaking valve.

Pressure losses may be caused by accumulation of solid particles in the pump (e.g., dragging of the reciprocating piston 32*p*), and/or from viscosity affect across the valve network 40. Pressure losses through dragging of the reciprocating piston 32*p* may also be determined from pressure measurements at chambers 31 and/or 33 and 36. For example, a difference between the measured pump chamber pressures should normally be equal to the resultant pressure ($P_R$) multiplied by a ratio. If not the case, this may indicate drag of the reciprocating piston 32*p*. If dragging of the reciprocating piston 32*p* is detected, operation of the pump system 100 may be stopped (e.g., before failure) or adjusted (e.g., pumping rate may be lowered to minimize production of solid particles from the formation). In contrast, pressure losses through valve network 40 may be determined from pressure measurements at chambers 31 and/or 33 and flowline 38. For example, a difference between a flow line pressure and a pump chamber pressure may be related to formation fluid viscous drag, which can be significant when pumping viscous formation fluids.

As described above, pump system 100 of tool 20 may be utilized for performing operations other than cleaning to obtain low contamination samples. For example, pump system 100 may be utilized to inflate packers 24*a*, over-pressurizing samples in sample containers 28*a*, performing mini-DST (e.g., miniature drill stem testing) and the like.

Inflation of packers 24*a* (FIG. 2) may comprise pumping fluid from wellbore 2 or sample chambers 28*a* through pumpout module 30 via displacement unit 32 into packer elements 24*a*. Packer elements 24*a* may have a differential pressure limit (e.g., the inflation pressure minus the hydrostatic pressure) that should not be exceeded. Traditionally, an inflate pressure gauge 62 (FIG. 2) is located in packer module 24. Gauge 62 may be a differential pressure gauge using hydrostatic pressure as a reference. When gauge 62 fails, which is not an uncommon event, the inferred pump hydraulic pressure from displacement unit 32 may alternatively provide monitoring of the inflate pressure of the packers.

A method for drawing fluid from formation "F" and/or wellbore 2 and storing in sample chamber 28*a* (FIG. 2) according to one or more aspects of the present disclosure is now described. Sample chambers are rated to a particular pressure differential and each sample chamber in tool 20 may have a different pressure differential rating. For example, multiple sample chambers may be rated from pressure differentials of 10 kpsi to 20 kpsi or more. When obtaining the fluid samples downhole (e.g., in wellbore 2) it may be important that the rated pressure differentials are not exceeded when filling the chamber. In the prior art system of FIG. 3, the inferred pump (e.g., displacement unit) output utilizing gauge 36 at power source 34 and the ratio of the two-stroke pump is used to determine if the rated pressure of sample chamber 28*a* is reached or surpassed. According to one or more aspects of the present disclosure, measurements at chamber gauge 50 and/or chamber gauge 52 and/or flowline gauge 56 may be utilized to determine the pressure applied to sample chamber 28*a*. Utilizing surface controller 19 and/or subsurface controller 18, which may be in electronic communication (wired and/or wireless) with one or more of pressure gauges 50, 52, 54, 56, 36 and displacement unit 32 (e.g., sensors 32*s*), pumping of fluid into the sample chamber may be ceased to prevent over pressurization of container 28*a*.

According to one or more aspects of the present disclosure, tool 20 may be utilized for performing miniature drill stem testing operations, referred to as a mini-DST herein. Pumpout system 30 (e.g., displacement unit 32, valve network 40, flowlines, etc.) may be configured in and in/out mode (e.g., I/O port). The mini-DST may be performed by providing a time period of pressure drawdown followed by a time period of pressure build up utilizing displacement unit 32. Unexplained pressure noise can make it difficult or impossible to interpret data due in part to the low drawdown utilized, for example, pressure noise due to improper valve sealing (e.g., mud valves CMV1-CMV4), movement of the reciprocation of piston 32*p*, etc. Pump system 100 and tool 20 according to one or more aspects of the present disclosure provide means for addressing drawbacks of prior systems. For example, flowline gauges 54 and/or 56 positioned on opposite sides of the displacement unit 32 provide a means for detecting and indentifying noise.

For example, flowline noise close to packer module 24 may be detected and/or measured by gauge 54 (FIG. 2) positioned on the low pressure side of displacement unit 32 and any changes in the hydrostatic pressure may be measured and/or detected by gauge 56 (FIG. 2) positioned on the high pressure side of displacement unit 32.

Also, pressure gauges 50, 52, 54 and/or 56 may be used to distinguish mud valve improper sealing from piston movement during a DST test. A pressure disturbance that correlates between one of the flow line gauges 54 and/or 56 and one of the pump chamber gauges 50 and/or 52 may be indicative of improper mud valve sealing (e.g., mud valves CMV1-CMV4). A pressure disturbance that does not correlate between flow line gauges and pump chamber gauges may indicate mud valve proper sealing. A pressure disturbance that correlates between one of the pump chamber gauges (e.g., 50) and the other of the pump chamber gauges (e.g., 52) and/or with the gauge 36 may be indicative of piston movement. A pressure disturbance that does not correlate between one of the pump chamber gauges and the other of the pump chamber gauges may be indicative of absence of piston movement.

Figure 6:
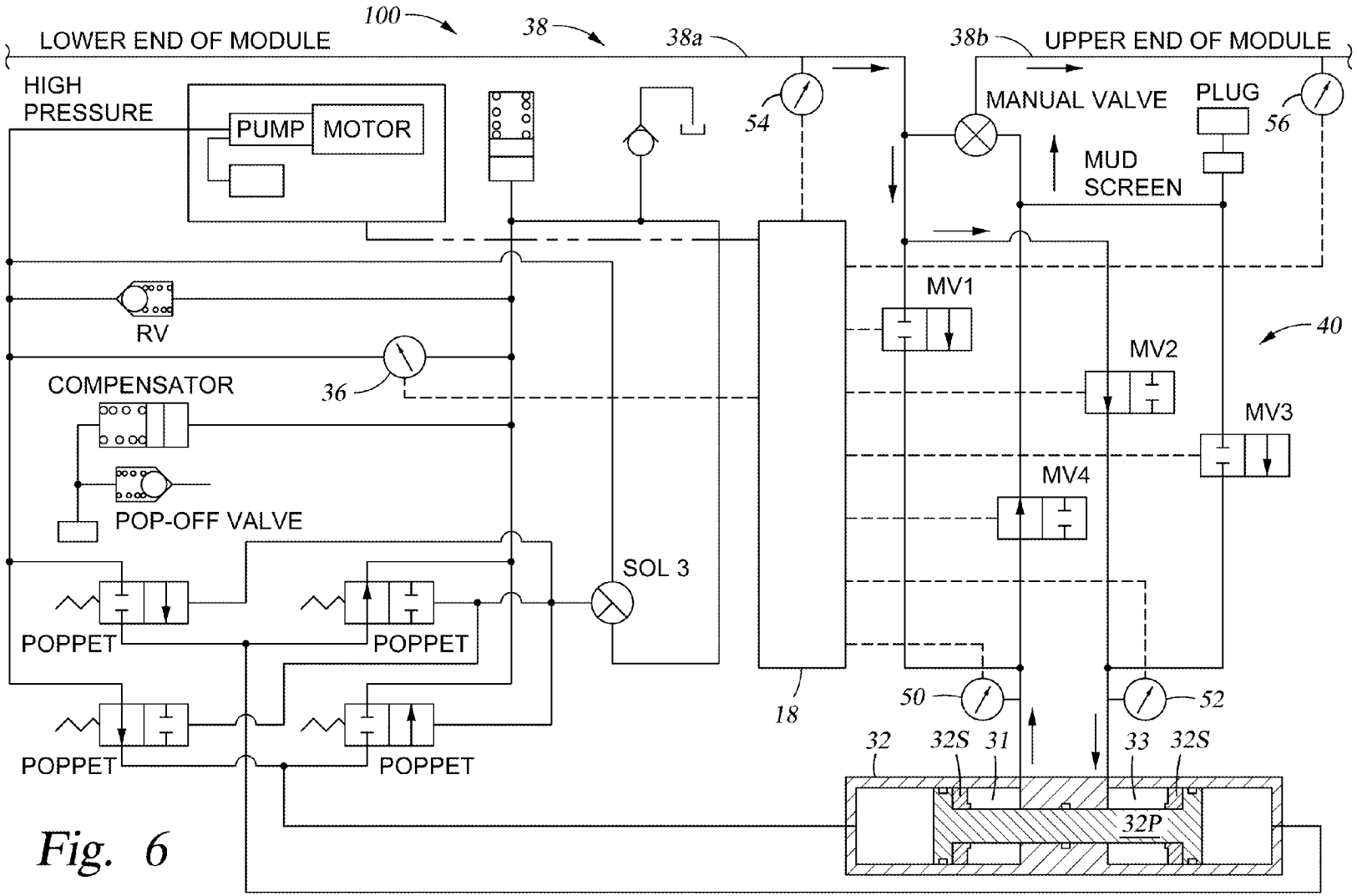
FIG. 6 is a schematic diagram of a system according to one or more aspects of the present disclosure utilizing active mud valves.

Mud valve network 40 may comprise passive and/or active mud valves (e.g., check valves, control valves). FIG. 6 a schematic diagram of pump system 100 utilizing active mud valves designated MV1-MV4. As opposed to passive mud valves (CMV1-CMV4), active mud valves (MV1-MV4) must be actuated open and closed as piston 32*p* reciprocates. Active valves MV1-MV4 may be actuated between open and closed positions via a controller, such as downhole controller 18. Active valves MV1-MV4 may be actuated via a power source such as the depicted hydraulic source 34 and/or electrical power. Depicted controller 18 may be configured to reproduce the action of the passive mud valves (e.g., check valves) in the active mud valves. To do so, controller 18 uses signals from chamber pressure gauges 50 and 52, flowing fluid pressure gauge (e.g., pressure gauge 54). Input from pressure gauge 56 may also be utilized.

Figure 7:
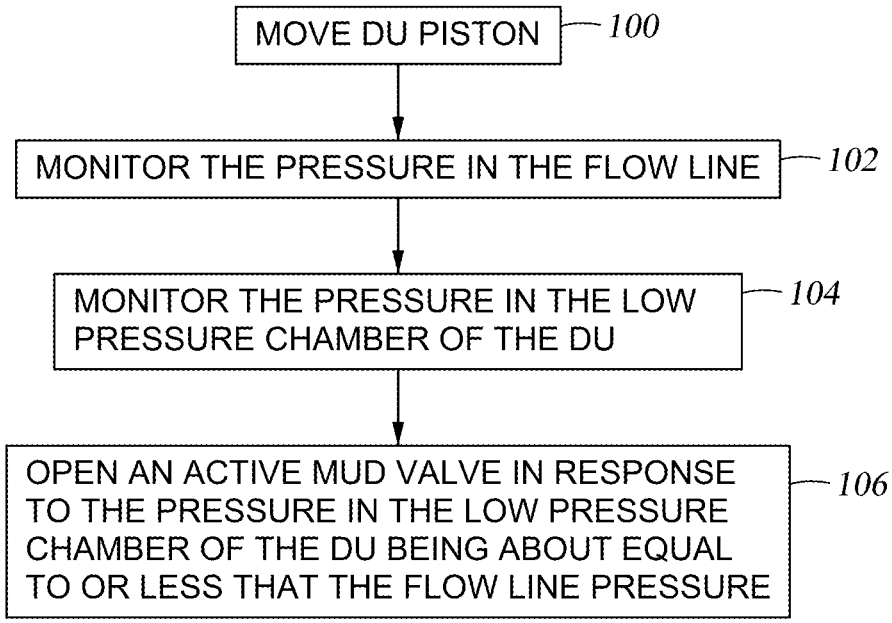
FIG. 7 is a schematic diagram of a method according to one or more aspects of the present disclosure.

Control of pump system 100 may be minimize and/or eliminate shocks to formation "F." If a mud valve is opened to too early in the pumping cycle, fluid may flow from a pump chamber 31, 32 into formation "F" and if a mud valve is opened too late, formation "F" will see an abrupt pressure drop which may be undesirable. A method, according to one or more aspects of the present disclosure, for minimizing shocks at formation "F" is now described with reference in particular to FIGS. 6 and 7. FIG. 7 depicts a pumping up operation. In step 100, piston 32*p* is actuated in a first direction (e.g., to the right in FIG. 6) for example via power supply 34. In step 102, the flowing pressure in flowline 38*a* is monitored via pressure gauge 54. In step 104, the pressure in the low pressure chamber is monitored via the respective chamber pressure gauge 50, 52. For pumping up, as depicted in FIG. 6, chamber 33 (e.g., pressure gauge 52) is the low pressure chamber when piston 32*p* is moving to the right as depicted in FIG. 6 and chamber 31 (e.g., pressure gauge 50) is the low pressure chamber when piston 32*p* is moving to the left. In step 106, a control valve is actuated to open in response to the pressure of the low pressure chamber being equal to or less than the flowing pressure (e.g., gauge 54). For example, when pumping up as depicted in FIG. 6, mud valve MV2 is opened when piston 32*p* is moving to the right as depicted in FIG. 6 and MV1 is actuated to the open position when piston 32*p* is moving to the left. While the method of FIG. 7 depicts a method to open the valve associated with a low pressure chamber, it will be apparent to those skilled in the art that similar methods may be used to operate (e.g., open) a valve associated with a high pressure chamber (e.g., chamber 31) based on the pressure measurement in the high pressure chamber (e.g. via gauge 30) and in the flowline 38*b* (e.g., via gauge 56).

According to one or more aspects of the present disclosure, a system for pumping fluid at least partially through a downhole tool disposed in a wellbore comprises a displacement unit for pumping the fluid; a first flowline hydraulically connected to the displacement unit through a valve network for selectively communicating the fluid to or from the displacement unit; a second flowline hydraulically connected to the displacement unit through the valve network for selectively communicating the fluid to or from the displacement unit; a first chamber pressure gauge hydraulically coupled with a first chamber of the displacement unit; and a second chamber pressure gauge hydraulically coupled with a second chamber of the displacement unit.

The system may comprise a first flowline pressure gauge hydraulically coupled to the first flowline across the valve network from the displacement unit. The system may comprise a first flowline pressure gauge hydraulically coupled to the first flowline across the valve network from the displacement unit; and a second flowline pressure gauge hydraulically coupled to the second flowline across the valve network from the displacement unit and the first flowline pressure gauge.

According to one or more aspects the system may comprise a sample probe hydraulically coupled to the first flowline; and a fluid sample chamber hydraulically coupled to the second flowline. The system may further comprise a first flowline pressure gauge hydraulically coupled to the first flowline between the sample probe and the valve network. The system may still further comprise a second flowline pressure gauge hydraulically coupled to the second flowline between the fluid sample chamber and the valve network.

The system according to one or more aspects of the present disclosure comprises a power supply providing a force to operate the displacement unit; a force sensor measuring the force supplied to the displacement unit; a sample probe hydraulically coupled to the first flowline; an inflatable member hydraulically coupled to the first flowline; a first flowline pressure gauge hydraulically coupled to the first flowline between the sample probe and the valve network; and a fluid sample chamber hydraulically coupled to the second flowline.

A method according to one or more aspects of the present disclosure comprises disposing a tool in a wellbore, the tool comprising a displacement unit for pumping a fluid at least partially through the tool, a first flowline hydraulically connected to the displacement unit through a valve network, and a second flowline hydraulically connected to the displacement unit; pumping a fluid from the first flowline to the second flowline; monitoring a pressure at a chamber of the displacement unit; and monitoring flowing pressure in the first flowline across the valve network from the displacement unit.

The method may comprise discharging the fluid to the hydrostatic pressure in the wellbore. The method may comprise pumping the fluid into a container and ceasing pumping fluid into the container in response to the pressure monitored at the chamber of the displacement unit being about a rated pressure of the container. The method may comprise performing a drill stem test utilizing the tool.

The method may comprise performing a drill stem test utilizing the tool and identifying pressure noise in response to at least one of monitoring the flowing pressure in the first flowline and measuring the pressure at the chamber of the displacement unit.

The method may comprise inflating a packer element by pumping fluid into the packer element to achieve an inflate pressure; and checking achievement of the inflate pressure relative to the monitored pressure at the displacement unit.

The method may comprise monitoring a pressure at a first chamber of the displacement unit; monitoring a pressure at the second chamber of the displacement unit; monitoring a pressure in the first flowline across the valve network from the displacement unit; and monitoring a pressure in the second flowline across the valve network from the displacement unit and the first flowline. The method may comprise further comprise identifying the occurrence of no fluid flow from the displacement unit in response to at least one of monitoring the pressure of the first chamber and monitoring the pressure of the second chamber, and at least one of monitoring the pressure of the first flowline and monitoring the pressure of the second flowline. The method may further comprise determining the effective stroke of the piston in response to determining the occurrence of no fluid flow.

According to one or more aspects of the present disclosure, a method comprises disposing a formation testing tool in a wellbore, the tool comprising a displacement unit for pumping a fluid at least partially through the tool, a first flowline hydraulically connected to the displacement unit through a valve network, and a second flowline hydraulically connected to the displacement unit, wherein the valve network comprises at least a first active valve hydraulically connecting the first flowline to a first chamber of the displacement unit and a second active valve connecting the second flowline to a second chamber of the displacement unit; moving a piston of the displacement unit; monitoring the flowing pressure in the first flowline; monitoring the pressure in the low pressure chamber of the first chamber and the second chamber; and opening one of the first active valve and the second active valve in response to the pressure in the low pressure chamber being about equal to or less than the monitored flowing pressure.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A system for pumping fluid at least partially through a downhole tool disposed in a wellbore, comprising:

a displacement unit configured to pump the fluid;

a first flowline hydraulically connected to the displacement unit through a valve network for selectively communicating the fluid to or from the displacement unit;

a second flowline hydraulically connected to the displacement unit through the valve network for selectively communicating the fluid to or from the displacement unit;

a first chamber pressure gauge hydraulically coupled with a first chamber of the displacement unit;

a second chamber pressure gauge hydraulically coupled with a second chamber of the displacement unit;

a power supply providing a force configured to operate the displacement unit;

a force sensor configured to measure the force supplied to the displacement unit;

a sample probe hydraulically coupled to the first flowline;

an inflatable member hydraulically coupled to the first flowline;

a first flowline pressure gauge hydraulically coupled to the first flowline between the sample probe and the valve network; and a fluid sample chamber hydraulically coupled to the second flowline.

2. The system of claim 1 wherein the first flowline pressure gauge is hydraulically coupled to the first flowline across the valve network from the displacement unit.

3. The system of claim 1 wherein the first flowline pressure gauge is hydraulically coupled to the first flowline across the valve network from the displacement unit; and further comprising a second flowline pressure gauge hydraulically coupled to the second flowline across the valve network from the displacement unit and the first flow line pressure gauge.

4. The system of claim 1 further comprising a second flowline pressure gauge hydraulically coupled to the second flowline between the fluid sample chamber and the valve network.

5. A method, comprising:

disposing a tool in a wellbore, the tool comprising a displacement unit for pumping a fluid at least partially through the tool, a first flowline hydraulically connected to the displacement unit through a valve network, and a second flowline hydraulically connected to the displacement unit;

pumping a fluid from the first flowline to the second flowline;

monitoring a first pressure at a first chamber of the displacement unit;

monitoring a second pressure at a second chamber of the displacement unit;

performing a drill stem test utilizing the tool; and identifying pressure noise in response to measuring the first and second pressures.

6. The method of claim 5 further comprising monitoring flowing pressure in the first flowline across the valve network from the displacement unit.

7. The method of claim 5 wherein pumping fluid comprises pumping fluid into a container, and wherein the method further comprises ceasing pumping fluid into the container in response to one or more of the first pressure monitored at the first chamber and the second pressure monitored at the second chamber being about a rated pressure of the container.

8. The method of claim 5 further comprising:

inflating a packer element by pumping fluid into the packer element to achieve an inflate pressure; and checking achievement of the inflate pressure relative at least one of the measured first and second pressures.

9. The method of claim 5 further comprising:

monitoring a pressure in the first flowline across the valve network from the displacement unit; and monitoring, a pressure in the second flowline across the valve network from the displacement unit and the first flowline.

10. The method of claim 9 further comprising identifying the occurrence of no fluid flow from the displacement unit in response to at least one of monitoring the first pressure at the first chamber and monitoring the second pressure at the second chamber, and at least one of monitoring, the pressure in the first flowline and monitoring the pressure in the second flowline.

11. The method of claim 9 further comprising:

identifying the occurrence of no fluid flow from the displacement unit in response to at least one of monitoring the first pressure at the first chamber and monitoring the second pressure at the second chamber, and at least one of monitoring the pressure in the first flowline and monitoring the pressure in the second flowline; and determining the effective stroke of the piston in response to determining the occurrence of no fluid flow.

12. A method, comprising:

disposing a formation testing tool in a wellbore, the tool comprising a displacement unit for pumping a fluid at least partially through the tool, a first flowline hydraulically connected to the displacement unit through a valve network, and a second flowline hydraulically connected to the displacement unit, wherein the valve network comprises at least a first active valve hydraulically connecting the first flowline to a first chamber of the displacement unit and a second active valve connecting the second flowline to a second chamber of the displacement unit;

moving a piston of the displacement unit;

monitoring flowing pressure in the first flowline;

monitoring pressure in the first chamber or the second chamber;

opening one of the first active valve and the second active valve in response to the pressure in the first chamber or the second chamber being about equal to or less than the monitored flowing pressure; and determining drag of the piston using a force sensor configured to measure force supplied to the displacement unit.

13. A method, comprising:

disposing a tool in a wellbore, the tool comprising a displacement unit for pumping a fluid at least partially through the tool, a first flowline hydraulically connected to the displacement unit through a valve network, and a second flowline hydraulically connected to the displacement unit;

pumping a fluid from the first flowline to the second flowline;

monitoring a first pressure at a first chamber of the displacement unit;

monitoring a second pressure at a second chamber of the displacement unit;

monitoring, a pressure in the first flowline across the valve network from the displacement unit; and monitoring a pressure in the second flowline across the valve network from the displacement unit and the first flowline;

identifying the occurrence of no fluid flow from the displacement unit in response to one or more of monitoring the first pressure at the first chamber and monitoring the second pressure at the second chamber, and one or more of monitoring the pressure in the first flowline and monitoring the pressure in the second flowline; and determining the effective stroke of the piston in response to determining the occurrence of no fluid flow.

14. The method of claim 13 wherein pumping fluid comprises pumping fluid into a container, and wherein the method further comprises ceasing, pumping fluid into the container in response to one or more of the first pressure monitored at the first chamber and the second pressure monitored at the second chamber being about a rated pressure of the container.

15. The method of claim 13 further comprising:

inflating a packer demerit by pumping fluid into the packer element to achieve an inflate pressure; and checking achievement of the inflate pressure relative to at least one of the monitored first and second pressures.

* * * * *